US010453294B2

(12) United States Patent
Hase et al.

(10) Patent No.: US 10,453,294 B2
(45) Date of Patent: Oct. 22, 2019

(54) SYSTEMS AND METHODS OF ELECTRONIC GAMING

(71) Applicant: Aristocrat Technologies Australia Pty Limited, North Ryde, NSW (AU)

(72) Inventors: Theodore Hase, Las Vegas, NV (US); Ryan Hawkins, Henderson, NV (US); Robert Honeycutt, Henderson, NV (US); Yanis Tsombanidis, Las Vegas, NV (US)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 0 days.

(21) Appl. No.: 15/276,067

(22) Filed: Sep. 26, 2016

(65) Prior Publication Data

US 2018/0089932 A1 Mar. 29, 2018

(51) Int. Cl.
*G07F 17/32* (2006.01)
*G07F 17/34* (2006.01)

(52) U.S. Cl.
CPC ..... *G07F 17/3213* (2013.01); *G07F 17/3206* (2013.01); *G07F 17/3225* (2013.01); *G07F 17/3246* (2013.01); *G07F 17/3251* (2013.01); *G07F 17/3258* (2013.01); *G07F 17/3267* (2013.01); *G07F 17/34* (2013.01)

(58) Field of Classification Search
CPC ..... G07F 17/3258; G07F 17/3293
See application file for complete search history.

(56) References Cited

U.S. PATENT DOCUMENTS 7,351,146 B2 * 4/2008 Kaminkow ..... G07F 17/3262 463/16
7,357,716 B2 * 4/2008 Marks ..... G07F 17/32 463/20
7,419,430 B1 * 9/2008 Joshi ..... G07F 17/32 273/292
7,758,416 B2 * 7/2010 Randall ..... G07F 17/32 463/20
7,780,520 B2 * 8/2010 Baerlocher ..... G07F 17/32 273/138.1
7,967,675 B1 * 6/2011 Delaney ..... G07F 17/34 463/16
8,109,821 B2 * 2/2012 Kovacs ..... G07F 17/3211 463/16

(Continued)

*Primary Examiner* — Xuan M Thai
*Assistant Examiner* — Malina D. Blaise
(74) *Attorney, Agent, or Firm* — Armstrong Teasdale LLP

(57) ABSTRACT

Systems, methods, and articles of manufacture for electronic gaming are disclosed. In a first aspect, a method of electronic gaming includes initiating, in response to an initial wager, a primary game, selecting, in response to the initiating the primary game, a plurality of primary game symbols, and displaying the plurality of primary game symbols in a plurality of symbol display positions associated with a plurality of reel strips. The method may further include initiating, in response to the initial wager, a jackpot game, selecting, in response to initiating the jackpot game, a jackpot game symbol from a plurality of jackpot game symbols, displaying the jackpot game symbol in a symbol display position associated with a single reel strip, and determining a jackpot award based upon the jackpot game symbol.

15 Claims, 9 Drawing Sheets

(56) References Cited

U.S. PATENT DOCUMENTS 8,137,180 B2 * 3/2012 Thomas ..... G07F 17/34 463/18
8,197,330 B2 * 6/2012 Englman ..... G07F 17/3244 463/20
8,591,313 B2 * 11/2013 Gomez ..... G07F 17/3206 463/16
8,608,543 B2 * 12/2013 Cuddy ..... G07F 17/3239 463/16
9,117,332 B2 8/2015 Chan
9,218,705 B2 * 12/2015 Taylor ..... G07F 17/3265
9,542,806 B2 * 1/2017 Gilbertson ..... G07F 17/32
9,754,459 B1 * 9/2017 Friedman ..... G07F 17/34
9,811,982 B2 * 11/2017 Meyer ..... G07F 17/34
2004/0072613 A1 4/2004 Visocnik
2005/0020341 A1 * 1/2005 Brosnan ..... G07F 17/32 463/16
2005/0101379 A1 * 5/2005 Falconer ..... G07F 17/34 463/25
2006/0068892 A1 * 3/2006 Gomez ..... G07F 17/3244 463/20
2006/0073878 A1 * 4/2006 Shackelford ..... G07F 17/3244 463/20
2006/0121978 A1 * 6/2006 Hornik ..... G07F 17/32 463/20
2006/0189377 A1 * 8/2006 Gomez ..... G07F 17/3244 463/20
2006/0189378 A1 * 8/2006 Aoki ..... G07F 17/3202 463/20
2007/0060321 A1 * 3/2007 Vasquez ..... G07F 17/32 463/27
2007/0066389 A1 * 3/2007 Kojima ..... G07F 17/32 463/31
2007/0167217 A1 * 7/2007 Kaminkow ..... G07F 17/32 463/20
2007/0207847 A1 * 9/2007 Thomas ..... G07F 17/32 463/17
2007/0259711 A1 * 11/2007 Thomas ..... G07F 17/32 463/22
2008/0146319 A1 6/2008 Yoshizawa
2009/0227345 A1 9/2009 Yoshizawa
2009/0291744 A1 * 11/2009 Chan ..... G07F 17/32 463/20
2010/0056252 A1 * 3/2010 Englman ..... G07F 17/32 463/20
2011/0201406 A1 8/2011 Jaffe et al.
2011/0201416 A1 * 8/2011 Jaffe ..... G07F 17/3258 463/27
2012/0094738 A1 * 4/2012 Aoki ..... G07F 17/3258 463/20
2013/0184050 A1 7/2013 Zoble et al.
2013/0184057 A1 * 7/2013 Bramble ..... G07F 17/3262 463/21
2014/0018147 A1 * 1/2014 Gobe ..... G07F 17/34 463/20
2014/0080563 A1 * 3/2014 Johnson ..... G07F 17/3227 463/13
2014/0087830 A1 3/2014 Gobe et al.
2015/0038213 A1 * 2/2015 Meyer ..... G07F 17/34 463/20
2015/0228163 A1 * 8/2015 Clarebrough ..... G07F 17/3213 463/20
2015/0254932 A1 * 9/2015 Boese ..... G07F 17/3258 463/10
2015/0310699 A1 * 10/2015 Meyer ..... G07F 17/34 463/20
2016/0328926 A1 * 11/2016 Boese ..... G07F 17/34
2019/0088087 A1 * 3/2019 Chim ..... G07F 17/3258

* cited by examiner

Buffalo Deluxe with Fast Cash Bonus Reel.

Fast Cash Bonus Reel spinning with "wind-up" in anticipation of a jackpot hitting.

Fast Cash Bonus Reel celebration with Major Jackpot.

SYSTEMS AND METHODS OF ELECTRONIC GAMING

BACKGROUND

The subject matter of the present disclosure relates to a method of electronic gaming, an electronic gaming system, and an article of manufacture for electronic gaming. Conventional gaming systems may employ symbol-driven jackpots, in which a jackpot prize is awarded based upon a winning combination of symbols. A need exists for alternative gaming systems.

SUMMARY

Systems, methods, and articles of manufacture for electronic gaming are disclosed. In a first aspect, a method of electronic gaming includes initiating, in response to an initial wager, a primary game, selecting, in response to the initiating the primary game, a plurality of primary game symbols, and displaying the plurality of primary game symbols in a plurality of symbol display positions associated with a plurality of reel strips. The method may further include initiating, in response to the initial wager, a jackpot game, selecting, in response to initiating the jackpot game, a jackpot game symbol from a plurality of jackpot game symbols, displaying the jackpot game symbol in a symbol display position associated with a single reel strip, and determining a jackpot award based upon the jackpot game symbol.

In another aspect, an electronic gaming system may include a display configured to display a wagering game, a player input interface configured to receive a player input, a credit input mechanism including at least one of a card reader, a ticket reader, a bill acceptor, and a coin input mechanism.

The electronic gaming system may further comprise a game controller and a tangible, non-transitory, computer-readable storage medium having instructions stored thereon that, in response to execution by the game controller, cause the game controller to perform operations including initiating, in response to an initial wager, a primary game, selecting, in response to the initiating the primary game, a plurality of primary game symbols, and displaying the plurality of primary game symbols in a plurality of symbol display positions associated with a plurality of reel strips. The game controller may further perform operations including initiating, in response to the initial wager, a jackpot game, selecting, in response to initiating the jackpot game, a jackpot game symbol from a plurality of jackpot game symbols, displaying the jackpot game symbol in a symbol display position associated with a single reel strip, and determining a jackpot award based upon the jackpot game symbol.

In yet another aspect, an article of manufacture a non-transitory, tangible, computer readable storage medium having instructions stored thereon that, in response to execution by a computer-based system configured for electronic gaming, cause the computer-based system to perform operations including initiating, in response to an initial wager, a primary game, selecting, in response to the initiating the primary game, a plurality of primary game symbols, and displaying the plurality of primary game symbols in a plurality of symbol display positions associated with a plurality of reel strips. The game controller may further perform operations including initiating, in response to the initial wager, a jackpot game, selecting, in response to initiating the jackpot game, a jackpot game symbol from a plurality of jackpot game symbols, displaying the jackpot game symbol in a symbol display position associated with a single reel strip, and determining a jackpot award based upon the jackpot game symbol.

BRIEF DESCRIPTION OF THE DRAWINGS

An exemplary embodiment of the subject matter disclosed will now be described with reference to the accompanying drawings.

DETAILED DESCRIPTION

Figure 1:
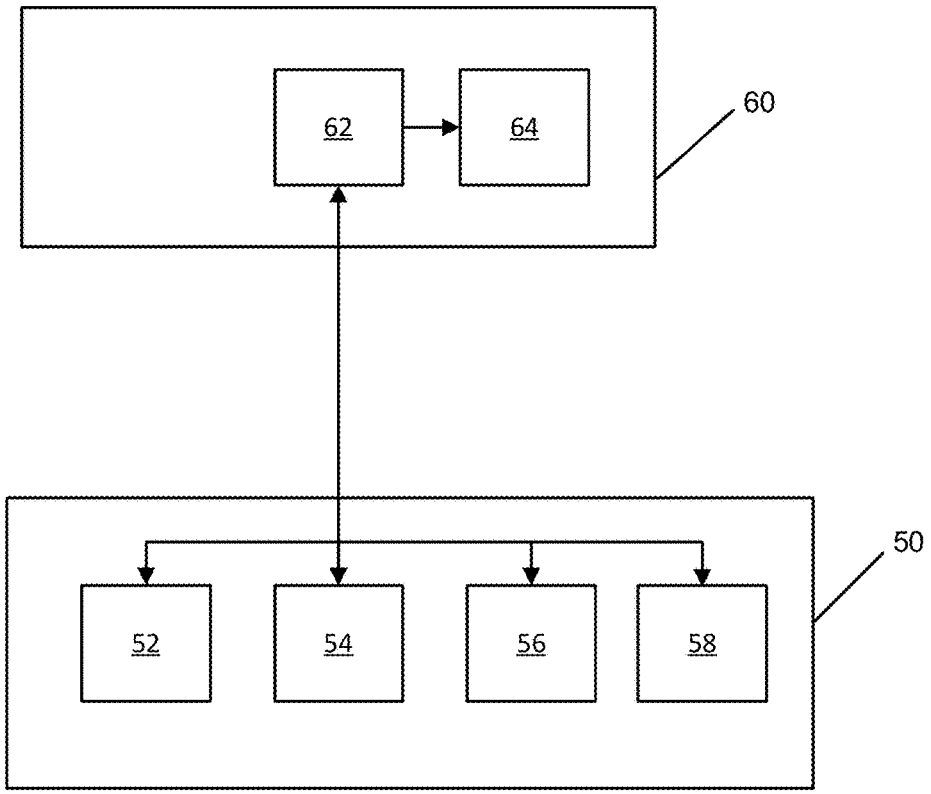
FIG. 1 is a block diagram of the exemplary components of a gaming machine.

Referring to the drawings, a gaming system that includes a game controller is shown. The game controller comprises components that enable the implementation concurrently played primary and jackpot games. The primary game and jackpot game may be initiated in response to an initial wager. Each game may also be funded by the initial wager. The jackpot game may be played on a single reel strip and may include a plurality of jackpot game award symbols, each associated with a particular jackpot award. A selected jackpot award symbol may thus directly correspond to a particular jackpot award.

General Construction of an Exemplary Gaming System

The present disclosure may be implemented in various configurations for gaming machines, including but not limited to: (1) a gaming machine in which the computerized instructions for controlling one or more games are stored within the gaming machine prior to delivery to a gaming establishment; and/or (2) a changeable gaming machine in which the computerized instructions for controlling one or more games are subsequently downloaded to the gaming machine through a data network after the gaming machine is installed within in a gaming establishment.

In an exemplary embodiment, the computerized instructions for controlling one or more games may be executed by a server, such as, for example, a central controller or remote host. In such a "thin client" architecture, the server may remotely control one or more games, or other suitable interfaces, via a gaming network, and the gaming machine may be used to display the games, or suitable interfaces, and to receive inputs or commands from a player.

In another exemplary embodiment, the instructions for controlling one or more games are communicated from a server to a local processor and memory coupled within a gaming machine. In such a "thick client" architecture, a processor of the gaming machine may execute the communicated instructions to control the game or games and/or other suitable interfaces provided to a player.

In another exemplary embodiment, one or more gaming machines within a gaming machine network may utilize a thin client architecture and one or more gaming machines within a gaming machine network may utilize a thick client architecture. Similarly, in various exemplary embodiments, certain functions of a particular gaming machine may be implemented in a thin client architecture and certain other functions of the gaming machine may be implemented in a thick client architecture. For instance, instructions for controlling a game or games may be communicated from a server to one or more network gaming machines operating in a thick client configuration, while instructions for controlling any secondary games or bonus gaming functions may executed by the server in a thin client configuration.

Figure 2:
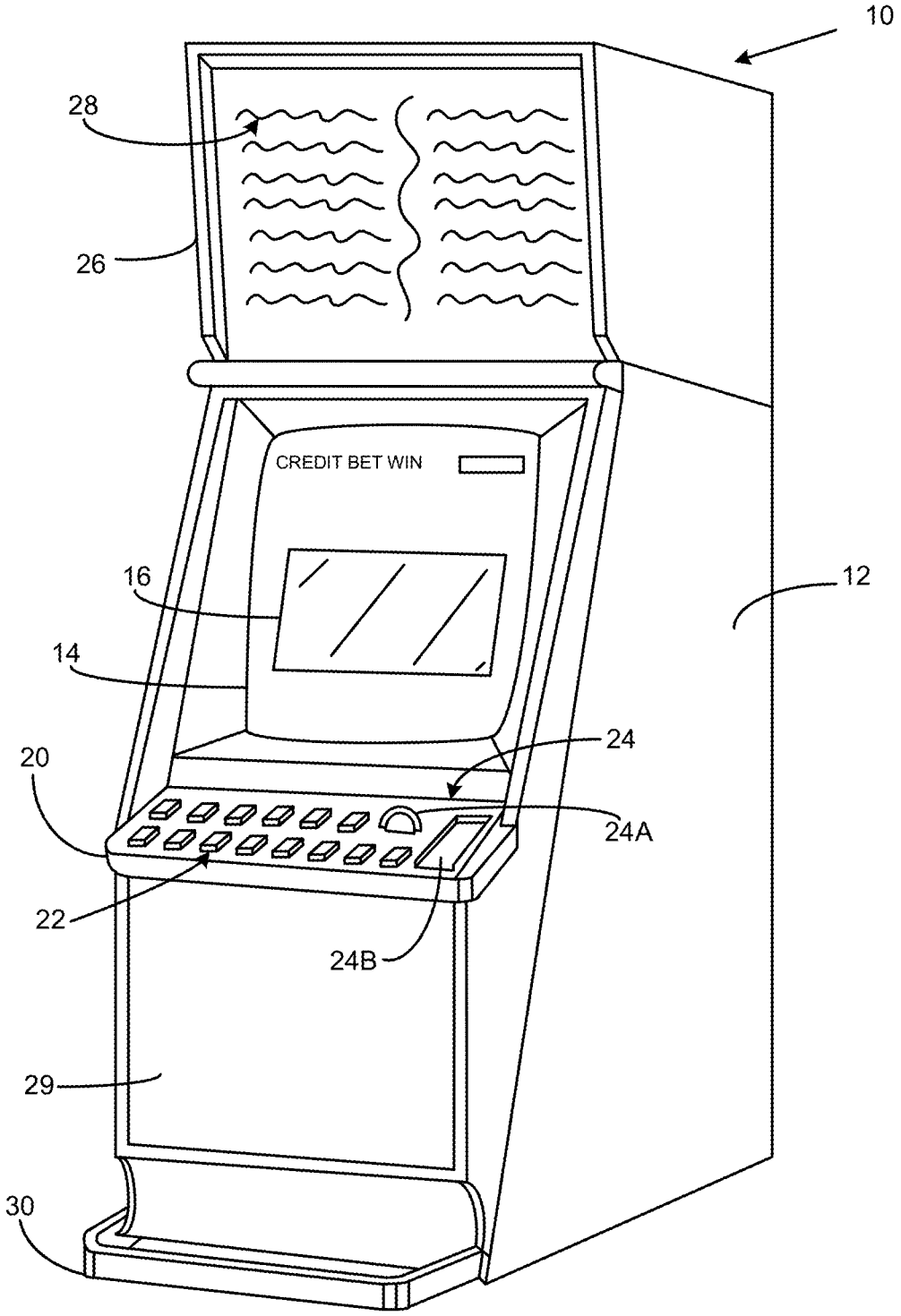
FIG. 2 is a perspective view of an exemplary gaming machine.

FIG. 2 is a perspective view of an exemplary gaming machine 10. Gaming machine 10 may include a support structure, housing, console or cabinet 12 that provides support for a plurality of interface units, displays, inputs, controls and other features of a conventional gaming machine. Gaming machine 10 may be configured so that a player can operate it while standing or sitting. Moreover, gaming machine 10 may be positioned on a base or stand, or can be configured as a pub-style table-top game (not shown) that a player can operate while seated. Gaming machine 10 may include varying numbers and styles of cabinets 12, display configurations, and the like without departing from the scope of the present disclosure.

In an exemplary embodiment, gaming machine 10 may include a display 14. Gaming machine 10 may further include a mid-trim 20, which may house a bank of buttons 22 for enabling a player to interact with gaming machine 10 and/or a credit input mechanism 24.

Gaming machine 10 may also include a player marketing module configured to scan or read a player tracking device, such as, for example a loyalty or player tracking card implemented within a casino as part of a loyalty program. The player tracking device may be in the form of a card, flash drive, and/or any other portable storage medium capable of being read by the reading device. In some embodiments, the player marketing module may be configured to transfer credits between gaming machine 10 and the player tracking device.

Gaming machine 10 may further include a top box 26, which may, in turn, include artwork 28, such as, for example, artwork depicting one or more pay tables, bonus award information, an upper display (not shown), and/or other game information or imagery. Further artwork and/or information may be provided on a front panel 29 of console 12. A coin tray 30 may be mounted beneath front panel 29 for dispensing cash payouts from gaming machine 10.

Display 14 may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In an exemplary embodiment, display 14 includes a touch-screen or touch-sensitive screen. In various embodiments, display 14 may be of any suitable size and configuration, such as any circular, square, rectangular, or other geometric configuration.

Display 14 may be further configured to provide haptic feedback. Top box 26 may also include a display, which may be of the same or different from display 14.

Display 14 may, in various embodiments, display a game and/or accept game play data from a player. Moreover, display 14 may also display information relating to an interactive game, wager triggering event, or wagering outcome. In an exemplary embodiment, an upper display (not shown) mounted in top box 26 may display any wagering outcome, any suitable secondary game associated or not associated with the interactive game, or any information relating to the interactive games. The upper display may also be configured to accept game play data from a player.

Display 14 may, in addition, serve as digital signage operable to advertise one or more games or other aspects of the gaming establishment. In an exemplary embodiment, gaming machine 10 may also include a credit or fund display 20, which may display a player's current number of credits, cash accumulated, account balance, an original number of credits the player funded the gaming machine with, or an equivalent of any of the aforementioned, and the like. Moreover, in an exemplary embodiment, display 14 may display an amount being wagered or an a player's accumulated winnings.

In an exemplary embodiment, and as described in greater detail herein, display 14 may display at least one game or game image, game symbol or symbols, and game indicia, such as any visual representation or exhibition of a movement of objects, including, for example, any mechanical, virtual, or video reels and wheels, dynamic lighting, video images, images of people, characters, places, things and faces of cards, and the like. In various embodiments, the symbols, images and indicia described above may be displayed mechanically, such as by one or more mechanical or physical reels. In other words, display 14 may include any electromechanical device, such as one or more rotatable or spinning wheels, reels or dice, any of which may be configured to display at least one or a plurality of games or other suitable images, symbols or indicia.

FIG. 1 is a block diagram of an exemplary player interface 50 and game controller 60 of gaming machine 10. Player interface 50 and game controller 60 may be housed within gaming machine 10, such as on a printed circuit board located within cabinet 12 of gaming machine 10. As described herein, player interface 50 may be arranged to enable manual interaction between a player and the gaming system and for this purpose includes various input/output components required for the player to enter instructions to play the game and observe the game outcomes.

Components of player interface 50 may include at least one credit input mechanism 24, at least one display 14, a game play mechanism 56 (including one or more input devices that enable a player to input game play instructions or place a wager), and/or one or more audio output devices 58 (e.g., one or more speakers).

Game controller 60 may be in data communication with player interface 50 and may include at least one processor 62 or other suitable controller, such as a microprocessor, a microcontroller-based platform, a suitable integrated circuit or one or more application-specific integrated circuits (ASICs). Processor 62 may be coupled in communication with, or may be operable to access or to exchange signals with, at least one data storage module or memory 64. Processor 62 may thus be configured to retrieve game play instructions from memory 64, process the game play instructions in accordance with game play rules, and output one or more game play outcomes to display 54.

Memory 64 may comprise any suitable tangible, non-transitory, computer-readable storage medium. Memory 64 may store program code and instructions, executable by processor 62, to control gaming machine 10. Memory 64 may also store other data, such as, for example, image data, one or more pay tables or pay table data, event data, player input data, random or pseudo-random number generators, or numbers generated by a random number of pseudo-random number generator, look-up table data, and/or information and applicable game rules that relate to the play of gaming machine 10.

Figure 3:
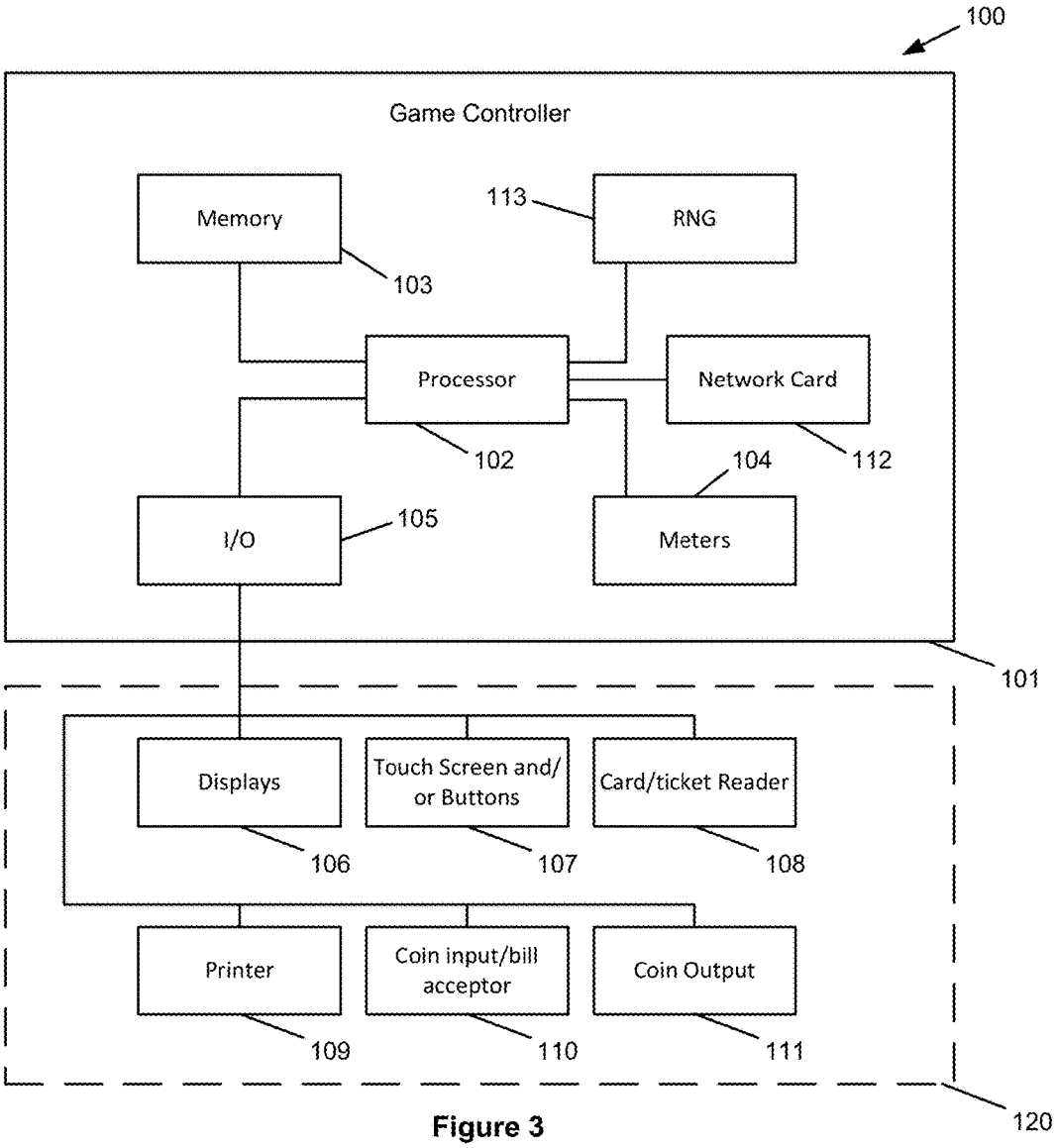
FIG. 3 is a block diagram of exemplary components of a gaming machine.
Figure 4:
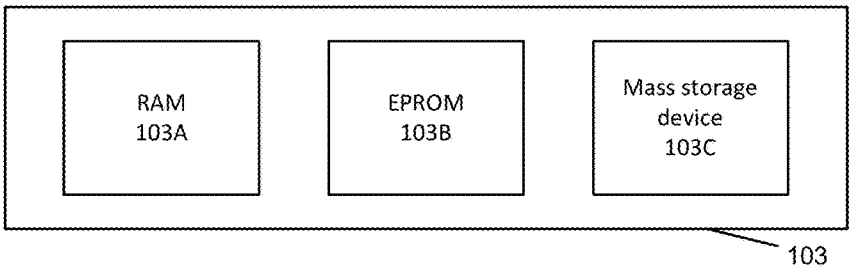
FIG. 4 is a schematic diagram of exemplary components of a memory.

With brief attention to FIG. 4, a block diagram of memory 64 is shown. Memory 64 may, in various embodiments, comprise a memory 103 (as described herein with reference to FIG. 3). Memory 103 may include random access memory (RAM) 103A, such as non-volatile RAM (NVRAM), magnetic RAM (MRAM), ferroelectric RAM (FeRAM) and other forms as commonly understood in the gaming industry. Memory 103 may further include read only memory (ROM), such as EPROM 103B or electrically erasable programmable read only memory (EEPROM). Memory 64 may further include one or more mass storage devices 103C, such as one or more hard drives, one or more solid state or flash memory components, one or more CD and/or DVD drives, and the like. Any other suitable magnetic, optical, and/or semiconductor memory may be used to operate in conjunction with gaming machine 10 that enables gaming machine 10 to function as described herein.

In an exemplary embodiment, RAM 103A may temporarily store one or more program files (and/or other related data) for execution by processor 62. EPROM 103B may comprise a boot ROM device and/or may contain some system or game related code. Mass storage device 103C may store one or more game programs, the integrity of which may be verified and/or authenticated by the processor 62 through the use of protected or encrypted code stored, for example, on EPROM 103B.

In various embodiments, part or all of the program code and/or operating data described above is stored in a detachable or removable memory, including, but not limited to, a suitable cartridge, disk, CD ROM, DVD or USB memory device. In addition, in various embodiments, all or part of the program code and/or operating data described above may be downloadable to memory 64 by way of any suitable computer network.

In an exemplary embodiment, a desktop computer, a laptop personal computer, a personal digital assistant (PDA), a smartphone, a tablet computing device or other portable computing device, and/or any other computerized platform may implement the computing operations of the present disclosure. For example, any suitable mobile computing device, such as any smartphone or tablet computing device, may implement and enable gameplay as described herein. It should be appreciated that each gaming machine 10 disclosed herein may comprise a device that has obtained approval from a regulatory gaming commission or a device that has not obtained approval from a regulatory gaming commission. It should also be appreciated that processor 62 and memory 64 may be collectively referred to herein as a "computer" or "controller."

Returning to FIG. 1, in an exemplary embodiment, credit input mechanism 24 may be coupled in communication with processor 62. Credit input mechanism 24 may include any suitable credit input mechanism or device, such as a coin input chute 24A, a bill or ticket collector 24B, and the like. Credit input mechanism may be configured to receive any suitable monetary credit, such as money, coins, tokens, tickets, and the like. In various embodiments, credit input mechanism 24 may further comprise card reader devices, such as credit or debit card readers or validators for credit cards, debit cards, printed ticket printers and/or readers, and the like.

In various embodiments, a player may insert an identification card (not shown) into a card reader of gaming machine 10. The identification card may be a smart card that includes a programmed microchip or a magnetic strip coded with a player's identification, credit totals (or related data) and other relevant information. A player may further carry a portable device, such as a cell phone or smart phone, a radio frequency identification tag or any other suitable wireless communication device, which communicates a player's identification, credit totals (or related data) and other relevant information to gaming machine 10. In an embodiment, money may be transferred to gaming machine 10 via an electronic funds transfer process. When a player funds gaming machine 10, processor 62 may determine an amount of funds entered and display the corresponding amount on the display 14.

Game play mechanism 56 may include at least one input device that is coupled in communication with processor 62. An input device may include any device that enables a player to produce an input signal that is receivable by processor 62. For example, in one embodiment, after funding gaming machine 10, the input device may comprise a game activation device, such as a pull arm or one or more play button 22 that enables the player to start the game or a sequence of events in gaming machine 10. Play button 22 may comprise any suitable play activator such as a bet one button, a max bet button, or a repeat the bet button. In an embodiment, after appropriate funding of gaming machine 10, game play may begin automatically.

In an exemplary embodiment, one input device may comprise a "Bet One" button. A player may place a wager or bet by pushing the Bet One button and may increase the wager by repeatedly depressing or selecting the Bet One button. In various embodiments, an input device comprises a "Bet Max" button that enables a player to place a maximum wager permitted during a particular game or game session.

In various embodiments, an input device may also comprise a "Cash Out" button. A player may depress or select a Cash Out button to receive a cash payment or other suitable form of payment corresponding to the number of credits remaining. In an embodiment, when the player cashes out, the player receives coins or tokens in a coin payout tray. A player may further receive tickets or credit slips, or the player's electronically recordable identification card may be funded, in response to selection of a Cash Out button.

In various embodiments, an input device may comprise a touch-screen that is coupled to a touch-screen controller, or some other touch-sensitive display overlay, to enable player interaction with images presented on display 14. A touch-screen and/or touch-screen controller may be communicatively coupled to a video controller, such that a player may provide input signals to gaming machine 10 by physically manipulating or interacting with the touch-screen.

Gaming machine 10 may include a sensor, such as a camera (not shown) coupled in communication with processor 62. The camera may, in various embodiments, be controlled by processor 62, such that a player may direct the orientation and focus of the camera to acquire an image of a player actively playing gaming machine 10 and/or a surrounding area of gaming machine 10. In an exemplary embodiment, the camera may selectively acquire still or moving (e.g., video) images and may be configured to acquire the images in either an analog, digital, or other suitable format. Display 14 may be configured to display the image acquired by the camera, as well as to display the visible manifestation of the game in split screen or picture-in-picture fashion. For example, the camera may acquire an image of the player and processor 62 may incorporate that image into the interactive and/or secondary game as a game image, symbol or indicia.

FIG. 3 illustrates a more detailed block diagram of various exemplary functional components of a gaming machine 100, which may be the same as or different from gaming machine 10 (as shown in FIG. 2). The foregoing description of components (e.g., display 14, player interface 50, and game controller 60) may therefore apply to the description of similar components in gaming machine 100. For instance, processor 62 may be the same as or different from 102, as described below. Similarly, memory 64 may be the same as or different from the memory 103, as described below.

Accordingly, gaming machine 100 may include a game controller 101 (which may include a processor 102 mounted on a circuit board, a described in greater detail above). Instructions and data to control operation of processor 102 may be stored in a memory 103 that is in data communication with processor 102. Gaming machine 100 may include both volatile and non-volatile memory and more than one of each type of memory, with such memories being collectively represented by memory 103.

Gaming machine 100 may further include hardware meters 104 (to ensure regulatory compliance and to monitor player credit) and/or an input/output (I/O) interface 105 (for communicating with peripheral devices of gaming machine 100). Input/output interface 105 and/or the peripheral devices may comprise intelligent devices with their own memory for storing associated instructions and data. A random number generator module 113 may generate random numbers for use by processor 102. Persons skilled in the art will appreciate that random number generator module 113 includes a pseudo-random number generator.

In an exemplary embodiment, a player interface 120 includes peripheral devices that communicate with game controller 101 including one or more displays 106, a touch screen and/or input buttons 107 (which provide a game play mechanism), and a credit input mechanism, such as a card and/or ticket reader 108, a printer 109, a bill acceptor and/or coin input mechanism 110, and a coin output mechanism 111. The credit input mechanism is configured to receive a credit wager to initiate play of a base game, and establish a credit balance (e.g., using the received credit wager) that is increasable and decreasable based on wagering activity within a game. Player interface 120 also includes a payout mechanism such as a printer 109 and/or a coin output mechanism 111. The payout mechanism is configured to output a payout to a player of gaming machine 100 based on an outcome of the game (e.g., a base game and/or a feature game).

Additional hardware may be included as part of gaming machine 100, or hardware may be omitted as required for the specific implementation. For example, although buttons or touch screens are typically used in gaming machines to allow a player to place a wager and to initiate a play of a game any input device that enables the player to input game play instructions may be used. For example, in some gaming machines a mechanical handle may be used to initiate a play of the game. Persons skilled in the art will also appreciate that a touch screen can be used to emulate other input devices, such as, for example, a touch screen that can display virtual buttons that a player can "press" by touching the screen where they are displayed.

In addition, gaming machine 100 may include a communications interface, such as, for example a network card 112. Network card 112 may, for example, send status information, accounting information and/or other information to a bonus controller, central controller, server or database and receive data or commands from the bonus controller, central controller, an/or server or database. In various embodiments (e.g., embodiments that employ a player marketing module), communications over a network may be via the player marketing module—e.g., the player marketing module may be in data communication with one or more of the above devices.

In various embodiments, components of gaming machine 100 may be distributed. For example, in an embodiment, input/output devices 106, 107, 108, 109, 110, and 111 may be provided remotely from game controller 101.

Figure 5:
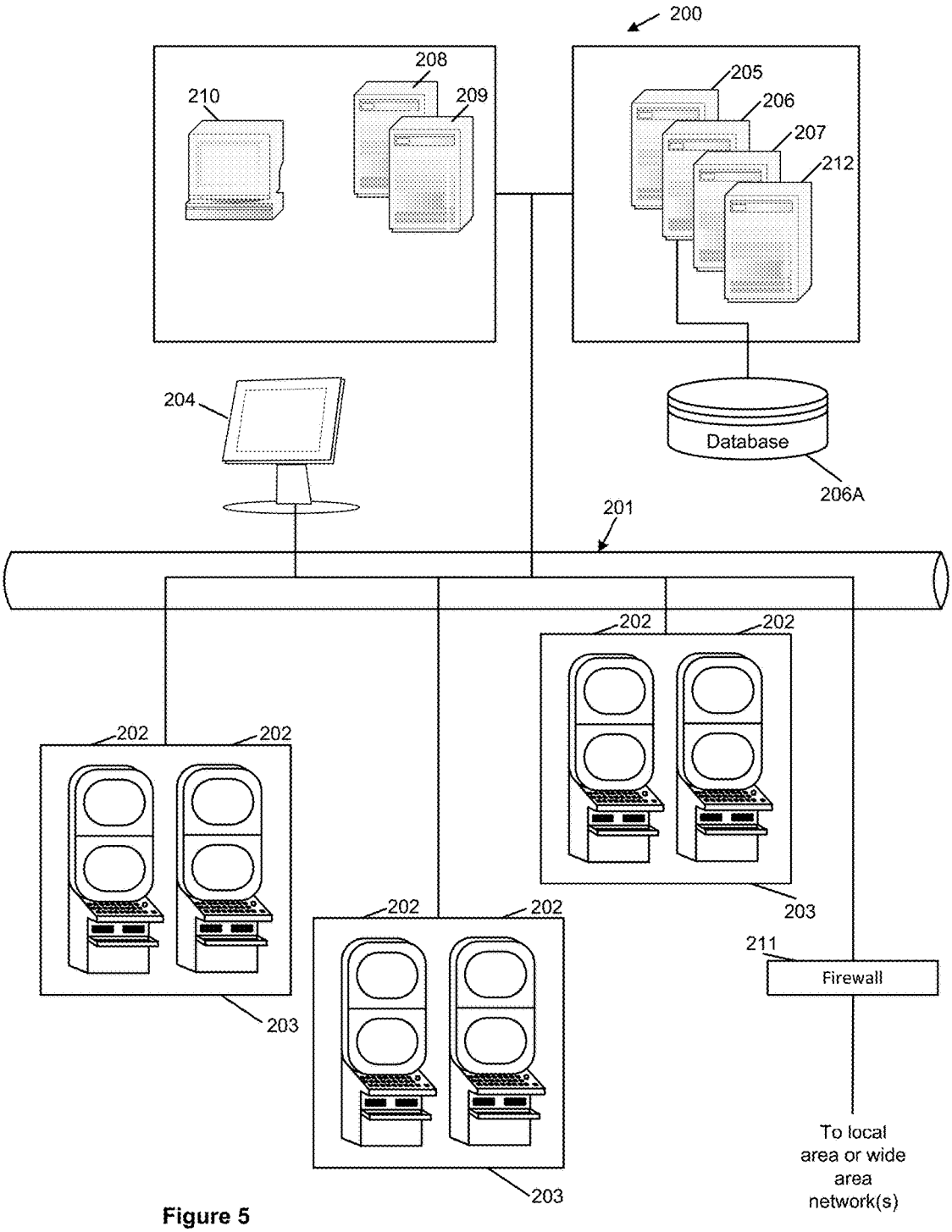
FIG. 5 is a schematic diagram of an exemplary network gaming system.

FIG. 5 illustrates such an exemplary distributed gaming system 200. Gaming system 200 may include a network 201, which, for example, may comprise a wired or wireless network, such as a Wi-Fi or BLUETOOTH network, an Ethernet network, an RS-232 network, and/or any combination thereof. In an exemplary embodiment, gaming machines 202, shown arranged in three banks 203 of two gaming machines 202, are connected to network 201. Gaming machines 202 may provide a player operable interface and may be the same as (or substantially similar to) the gaming machines 10 and 100 (as shown in FIGS. 2 and 3), or may have simplified functionality depending, for example, on various game play requirements.

One or more displays 204 may also be connected to network 201. For example, displays 204 may be associated with one or more banks 203 of gaming machines. Displays 204 may be used to display representations associated with game play on gaming machines 202 and/or used to display other representations, such as, for example promotional or informational material. Displays 204 may be the same as or substantially similar to display 14, as described above.

In a thick client embodiment, game server 205 may implement part of the game played by a player using gaming machine 202, and gaming machine 202 may implement part of the game. In such an embodiment, insofar as both game server 205 and gaming machine 202 may implement part of the game, they may collectively comprise a game controller. A database management server 206 may manage storage of game programs and associated data for downloading or access by gaming machines 202 in a database 206A. Typically, if gaming system 200 enables players to participate in a jackpot game, a jackpot server 207 may be provided to perform accounting functions for the jackpot game. A loyalty program server 212 may also be provided.

In a thin client embodiment, game server 205 may implement most or all of the game played by a player using gaming machine 202, and gaming machine 202 may, in essence, function provide little more than the player interface. In such an embodiment, game server 205 may comprise the game controller. Gaming machine 202 may thus receive player instructions and transmit those instructions to game server 205. Further, in a thin client embodiment, gaming machines 202 may be computer terminals, such as, for example, personal computers, laptop computers, tablet computing devices, smartphones, and the like running software that provides a player interface. Other client/server configurations are contemplated and are within the scope of this disclosure. Additional details of a client/server architecture may be found in WO 2006/052213 and PCT/SE2006/000559, the disclosures of which are incorporated herein by reference in their entireties.

One or more servers may be provided to assist in the administration of gaming system 200. Such servers may include, for example, a gaming floor management server 208, and a licensing server 209 to monitor the use of licenses relating to particular games. An administrator terminal 210 may be provided to allow an administrator to run network 201 and the devices connected to network 201.

Gaming system 200 may communicate with other gaming systems and/or other local networks, such as, for example a corporate network, and/or a wide area network such as the Internet Communications may be filtered through a firewall 211.

Persons skilled in the art will appreciate that in accordance with known techniques, functionality at the server side of network 201 may be distributed over a plurality of different computers. For example, elements may be run as a single "engine" on one server or a separate server may be provided. For example, game server 205 may implement a random number generator engine. Alternatively, a separate random number generator server may be provided. Further, persons skilled in the art will appreciate that a plurality of game servers may be provided to implement different games or a single game server may implement a plurality of different games as required by the terminals.

Further Details of an Exemplary Gaming System

In an exemplary embodiment, a player may place a wager using the game play mechanism 56. A game (or game session) may be initiated in response to placement of the wager, a plurality of symbols randomly drawn, and a game (or game session) outcome determined based upon the symbols drawn. A game outcome may be compared to a pay table (which may be stored in a computer memory) to determine a payout or award (also referred to herein as a win entitlement). Persons skilled in the art will appreciate that a player's wager can be varied from game to game dependent on player selections.

In various embodiments, a wager may include a selection of a number of lines to be played during a game session. Such lines may comprise an interconnected combination of symbol display positions. Each selected line may be evaluated to identify winning combinations of symbols. A pay table (e.g., a pay table stored in memory 64) may be referenced to identify a payout or award based upon an identified winning combination of symbols. In various embodiments, an award may be multiplied or increased by a multiplication factor as well.

In an exemplary embodiment, gaming machine 202 may generate an award that is not based solely upon a number of a lines selected. For example, "scatter" pays (e.g., randomly selected awards that are not identified based upon a plurality of adjacent symbols) may be awarded independently of a player's selection of pay lines.

Further, in various embodiments, a player may select a number of reels (virtual or physical) to play. Games of this type are marketed under the trade name "Reel Power" by Aristocrat Leisure Industries Pty Ltd and are also known as "ways" to win games. Such a reel selection option may permit the substitution of one displayed symbol for another. In other words, all symbols displayed at symbol display positions corresponding to a selected reel may be used to form symbol combinations with symbols displayed at designated symbol display positions of the other reels. For example, if there are five reels and three symbol display positions for each reel, such that the symbol display positions comprise three rows of five symbol display positions, the symbols displayed in the center row may be used for non-selected reels. As a result, the total number of ways to win may be determined by multiplying the number of active display positions of each reel, the active display positions being all display positions of each selected reel and the designated display position of the non-selected reels. In this example, for five reels and fifteen display positions, there are 243 ways to win.

As described in greater detail below, a symbol display may comprise a matrix (e.g., a rectangular matrix) of symbol display positions. The matrix of symbol display positions may, in turn, comprise a plurality of columns and a plurality of rows. In various embodiments, the number of symbol display positions associated with a column may vary from one column to the next. For example, in an exemplary embodiment, a symbol display may include five columns, in which the first column, the third column, and the fifth column include three symbol display positions and in which the second and fourth columns include four symbol display positions (e.g., a 3-4-3-4-3 column formation). Such a column formation includes seventeen display positions. Moreover, in such a formation, adjacent columns may be offset or staggered relative to one another.

As used herein, the terms "primary game" and "base game" may refer to games initiated in response to one of a plurality of game initiation events, such as a wager or credit being received by or transferred to gaming machine 100. A primary game may be associated with a primary game outcome represented by a plurality of primary game symbols, each of which may be selected based upon a random number generated by random number generator 113 (as described more generally above).

Further, as used herein, the terms "secondary game" and "bonus game" may refer generally to a game or a component of a game involving procedures in addition to the primary game. A secondary game may be associated with a secondary game outcome represented by a plurality of secondary game symbols, each of which may be selected based upon a random number generated by random number generator 113 (as described more generally above). A secondary game may be initiated after, or during, a primary game and in response to the occurrence of a particular condition during the primary game. A secondary game may result in a game outcome that increases a primary game award or adds a secondary game award to a primary game award.

The combination of the primary game and the bonus game may be referred to herein as a "game session," unless another meaning is clearly intended. An individual game session is generally associated with a particular time period, and the next individual game session follows the particular time period. Thus, a plurality of individual game sessions may be played in sequence (e.g., one after another).

As used herein, a "reel strip" may comprise a plurality of symbol display positions, each capable of displaying a symbol. More particularly, a symbol display position may include or display a primary game symbol, a secondary game symbol, or a jackpot game symbol, depending, for example, upon the stage of game play. For instance, during a primary game, a symbol display position may include or display a primary game symbol, while during secondary game play, a symbol display position may include or display a secondary game symbol.

As used herein, a reel strip may comprise a virtual, or computer-generated, reel strip as well as a physical, or mechanical, reels strip. Thus, a virtual reel strip may be displayed on a display of a gaming machine, such as display 106. A virtual reel strip may be animated, such that the reel strip appears to spin, much like a physical reel strip. Thus, as used herein, a reel strip may be described as "spinning" or in conjunction with the term "spins" to indicate that the reel strip, if it is a virtual reel strip, is animated by a game controller such that the reel strip is given the appearance of motion or of spinning.

Figure 6:
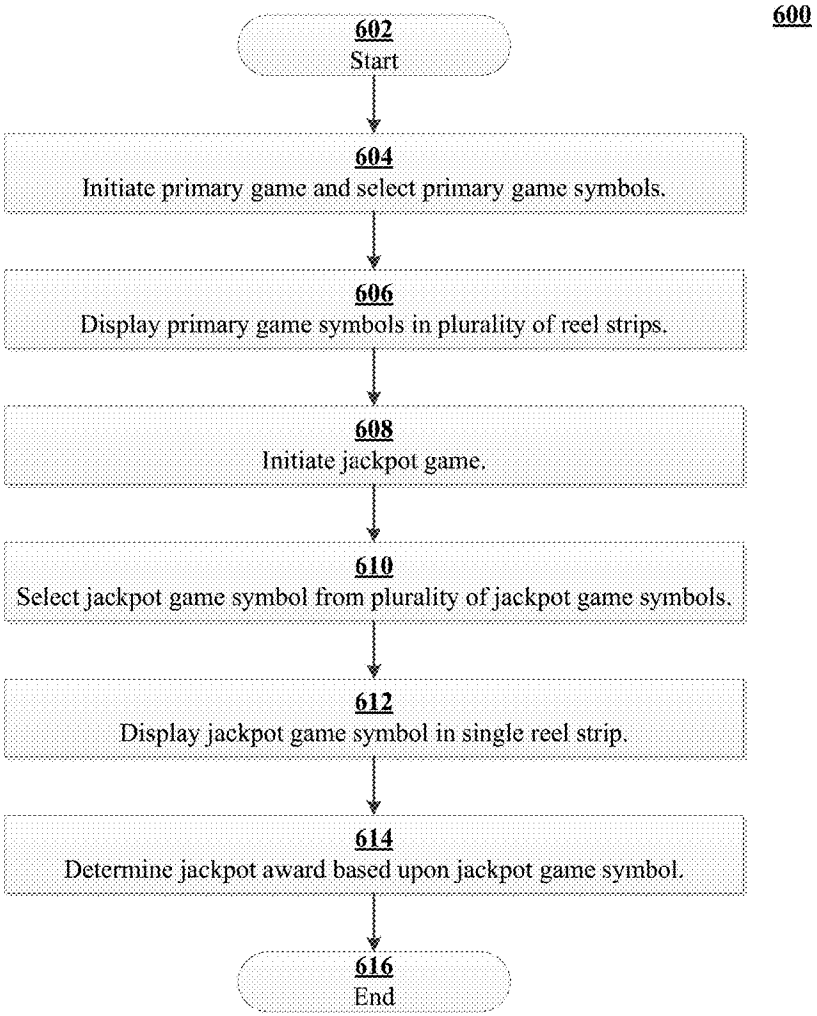
FIG. 6 is a flowchart of an exemplary method of electronic gaming.

With reference now to FIG. 6, a process 600 for electronic gaming is shown. Process 600 is described with reference to a game controller, such as game controller 60 of gaming machine 10 or game controller 101 of gaming machine 100. Process 600 is described below with reference to game controller 60; however, those of skill will appreciate that process 600 may be implemented by game controller 101 and/or any other suitable game controller or game processor.

Accordingly, in an exemplary embodiment, game controller 60 may initiate a primary game and, in accordance with game play rules associated with the primary game, select a plurality of primary game symbols (step 604). The primary game may be initiated in response to a wager or bet provided by a player to the gaming machine. The primary game symbols may be themed or associated with a primary game theme. For example, a beach themed primary game may include primary game symbols such as surfboards, beachgoers, beach balls, and the like.

The selected primary game symbols may be displayed by game controller 60 (step 606). More particularly, game controller 60 may fill a plurality of symbol display positions (or reel strips that include symbol display positions) with the plurality of selected primary game symbols to display a primary game outcome as a combination of primary game symbols. More particularly, game controller 60 may animate each reel strip such that each reel strip appears to spin. Game controller 60 may likewise stop each reel strip on the selected primary game symbol, such that each selected primary game symbol is displayed on its respective reel strip. Further, as described herein, the primary game symbols forming the primary game outcome may be compared to a pay table to determine whether to award a primary game award or prize.

During primary game play, game controller 60 may initiate a jackpot game (step 608). Like the primary game, the jackpot game may be initiated in response to a wager or bet provided by a player to the gaming machine. The jackpot game may, in this respect, be initiated concurrently with the primary game and in response to the same wager that initiated the primary game. More particularly, the initial wager may be divided or split to initiate the primary and jackpot games. Further, having divided the initial wager, a first portion of the initial wager may be applied to the primary game, and a second portion of the initial wager may be applied to the jackpot game. Therefore, and as used herein, a jackpot game may comprise a "concurrent game," in that the jackpot game is triggered based upon an initial wager (rather than, for example, an outcome of the primary game) and/or played concurrently with the primary game. The primary game and jackpot game may also be funded by the first portion and second portion of the initial wager, respectively. In various embodiments, the jackpot game may comprise a secondary game, as described in greater detail below.

As a result of the concurrent allocation of the initial wager between the primary game and the jackpot game, a total jackpot, which is described in greater detail below, may increase at a rate that permits frequent jackpot awards. For example, in an exemplary embodiment, the total jackpot may increase at a rate that permits allocation of all or a portion of the total jackpot to a player every two to three days. In certain embodiments, the odds of winning a jackpot award are one in one-hundred-and-twenty-five. Thus, the jackpot awards described herein may be perceived by players as being relatively attainable or more easily achieved.

The jackpot game may be associated with a plurality of jackpot game symbols. Jackpot game symbols may include a discrete number of symbols, such as, for example, "Grand," "Super," "Big," "Major," "Minor," and "Mini" jackpot game symbols, each of which may be associated with a particular jackpot award. In an exemplary embodiment, jackpot awards may descend in value from a highest jackpot award associated with a "Grand" jackpot game symbol to a lowest jackpot award associated with a "Mini" jackpot game symbol. A "Grand" jackpot game symbol may, for example, be associated with a total jackpot amount, while each of the lesser awards may be associated with a portion of the total jackpot amount. The intermediate jackpot game symbols Super," "Big," "Major," and "Minor" may, in addition, be associated with jackpot awards having a value between the value associated with the "Grand" award and the value associated with the "Mini" award. In various embodiments, any other suitable number of jackpot game symbols may be displayed. Further, any symbol logo, symbol identifier, symbol image, or symbol text may be associated with one or more jackpot game symbols. Jackpot game symbols are not limited to the "Grand," "Super," "Big," "Major," "Minor," and "Mini" labels described above. In various embodiments, jackpot symbols may be associated with multipliers (or multiplication factors), credit or cash prizes, game enhancements, bonus or secondary game triggers, and the like.

During operation, game controller 60 may further select a jackpot game symbol from the plurality of jackpot game symbols (step 610), and the selected jackpot game symbol may be displayed by game controller 60 on a single reel strip (step 612). More particularly, game controller 60 may fill one or more symbol display positions on a single, designated, reel strip with the plurality of jackpot game symbols. In this respect, and as used herein, the reel strip that includes the one or more jackpot game symbols may be referred to as a "jackpot game reel strip." In an exemplary embodiment, jackpot game symbols may be separated by one or more blank spaces or blank symbols on a jackpot game reel strip. However, in other embodiments, the jackpot game symbols may not be separated from one another by blank symbols. Game controller 60 may animate the jackpot game reel strip such that the jackpot game reel strip spins. Game controller 60 may likewise stop the jackpot game reel strip on the selected jackpot game symbol, such that the selected jackpot game symbol is displayed, as described above.

Game controller 60 may, in addition, determine a jackpot game award based upon the selected jackpot game symbol (step 614). For example, game controller 60 may determine a jackpot award based upon whether the jackpot award symbol is a "Grand," "Super," "Big," "Major," "Minor," or "Mini" jackpot game symbol. However, in various embodiments, the jackpot award may be determined based upon any other jackpot award symbol. Notably, presentation of a single discrete jackpot award symbol that is associated with a particular jackpot award may introduce a "what you see is what you get" (or "WYSIWYG") aspect to the jackpot game. For instance, a jackpot award is not linked, in a WYSIWYG jackpot game, to a combination of symbols, but, as described, to a single symbol that is associated with a discrete jackpot award. Thus, a player may not have to wait for game controller 60 to make an award determination in a jackpot game to understand what the jackpot award will be, because the player may simply compare the selected jackpot game symbol to a particular jackpot award (e.g., a jackpot award, as described below with respect to FIG. 10, that is presented on an overhead display).

In an exemplary embodiment, game controller 60 may select the plurality of primary game symbols concurrently with the jackpot game symbol (or a blank symbol on the jackpot game reel strip). For example, game controller 60 may spin each of the plurality of reel strips that include the primary game symbols concurrently with the jackpot game reel strip. Thus, the outcome of the primary game may be determined (and displayed) by game controller 60 concurrently with the outcome of the jackpot game. Specifically, game controller 60 may display each reel in the plurality of reels associated with primary game symbols, such that each reel strip stops simultaneously or in series (e.g., moving from left to right across the game display). Similarly, game controller 60 may display the jackpot game reel strip such that the jackpot game reel strip stops simultaneously, or in series, with the stopping of the plurality of primary game reel strips. In an exemplary embodiment, each reel strip may stop in series, moving from left to right. Where the reel strips are brought to a stop in this manner, the jackpot game reel strip may be the last reel strip to come to a complete stop.

The primary game and jackpot games may therefore be initiated concurrently as result of a single initial wager. In addition, the outcome of each of the primary and jackpot games may be displayed simultaneously or substantially simultaneously during a particular set of reel spins for a particular concurrent set of primary and jackpot games.

Further, in certain embodiments, game controller 60 may initiate a secondary game (or a series of secondary games, which may be referred to herein as a "secondary game session"). The secondary game may be associated with a plurality of secondary game symbols. Moreover, a jackpot game may be initiated during a secondary game. Thus, in some embodiments, a jackpot game may be initiated during a primary game, during a secondary game, or during a combination of primary and secondary games.

Figure 7:
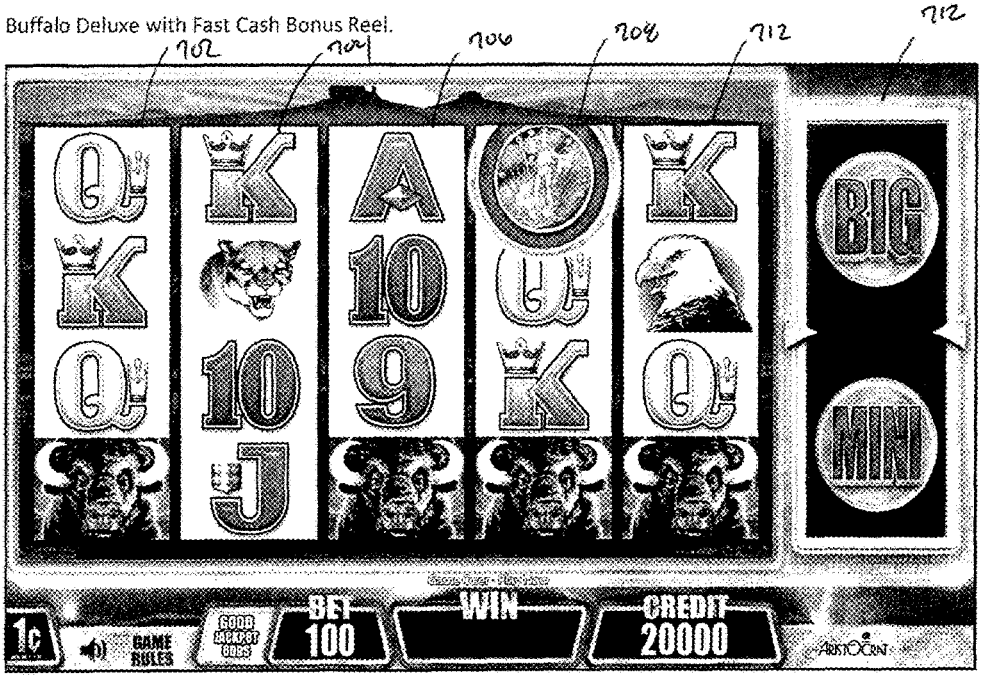
FIG. 7 is a screenshot of an exemplary embodiment in which a primary game and a jackpot game are initiated.
Figure 8:
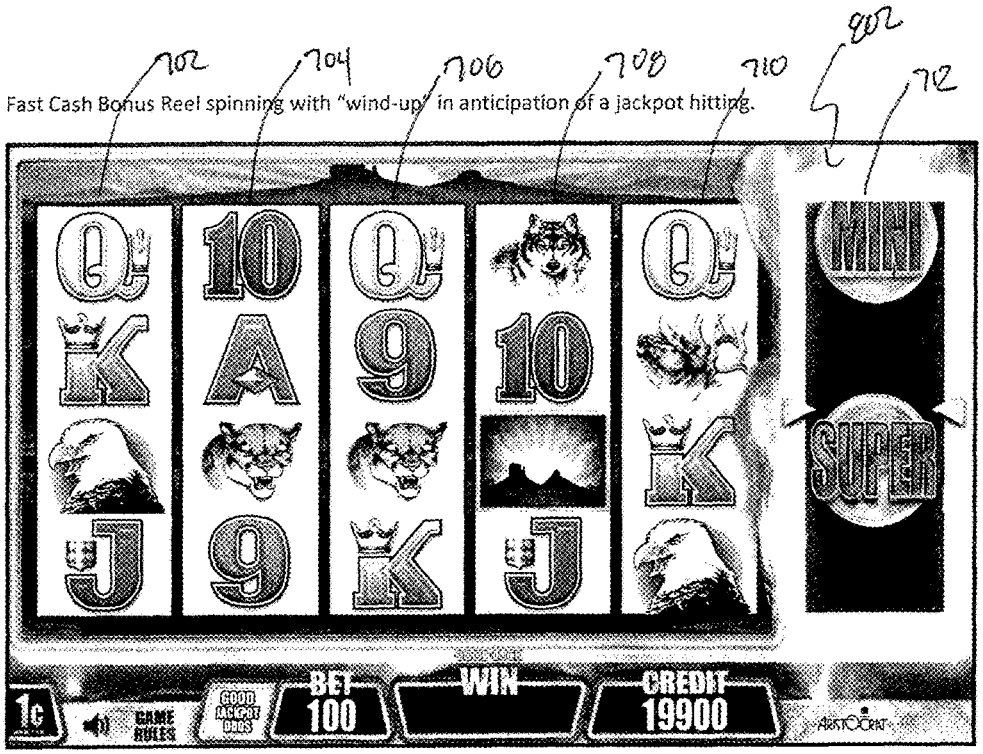
FIG. 8 is a screenshot of an exemplary embodiment in which a first windup image is displayed in association with a jackpot game.
Figure 9:
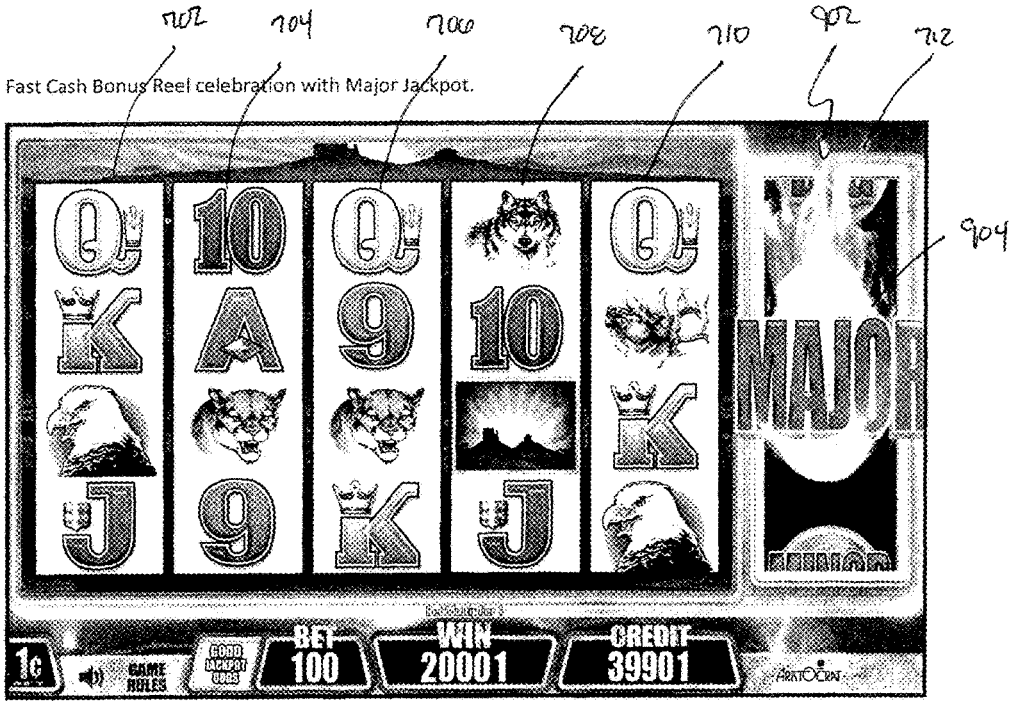
FIG. 9 is a screenshot of an exemplary embodiment in which a second windup image is displayed in association with a jackpot game.

With reference now to FIGS. 7, 8, and 9, screenshots of an exemplary embodiment are shown. More particularly, exemplary sequences of images displayed by game controller 60 (e.g., on a display of gaming machine 10 or 100, such as display 14 or 106, respectively) are shown. Each of the screenshots in FIGS. 7, 8, and 9 illustrates a particular concurrent primary and jackpot game in which primary game reel strips and a single jackpot game reel strip spin until a primary game outcome and jackpot game outcome are determined. The screenshots further illustrate an animated image, which may be presented to a player, in advance of a jackpot award. As used herein, such an animated image may be referred to as a "windup" image, and may signal to a player that a jackpot symbol is about to be displayed in a jackpot reel strip—e.g., and as used herein, that a jackpot symbol is about to "land" on the jackpot game reel strip.

The windup image may, as described below, be used to draw a player's attention to a jackpot game reel strip prior to the display of a jackpot symbol (representing a jackpot award) on the jackpot game reel strip. Absence of such a windup image during gameplay may, in addition, focus a player's attention on the plurality of primary game reel strips during primary and jackpot games that do not include a jackpot symbol. Thus, the windup image may keep a player's attention on primary game or jackpot game reel strips, depending, for example, upon whether a jackpot game award is being awarded or is about to be awarded.

Accordingly, with reference to FIG. 7, an exemplary plurality of primary game reel strips 702, 704, 706, 708, and 710 and a single jackpot game reel strip 712 are shown. The screenshot of FIG. 7 captures the primary game reels strips 702-710 and the jackpot game reel strip 712 mid-spin. Thus, at FIG. 7, no reel strip is yet shown in a stopped position. Notably, however, game controller 60 initiates motion of the primary game reel strips 702-710 and the jackpot game reel strip 712 in response to a wager placed by a player. As described above, the wager value may be divided between the primary game and the jackpot game, and the primary game reel strips 702-710 and the jackpot game reel strip 712 may spin concurrently.

With reference to FIG. 8, game controller 60 may select a plurality of primary game symbols from each of the primary game reel strips 702-710 and a jackpot game symbol 804 from jackpot game reel strip 712. Reel strips 702-710 and 712 may begin to spin more slowly (or the reel strips 702-710 may begin to stop, moving from left to right across the display), and as this occurs, a windup image 802 may be displayed in association with the jackpot game reel strip 712 and/or the selected jackpot symbol. Windup image 802 may comprise any animated or still image that may be shown in association with selected jackpot game symbol, such as, for example, and in an illustrative embodiment, an animated image of a flame that engulfs or surrounds jackpot game reel strip 712 and/or the upcoming jackpot symbol. Windup image 802 may further direct a player's attention to jackpot game reel strip 712 and/or the selected jackpot symbol as each reel strip 702-710 and 712 slows to a halt to display the selected primary game symbols and the selected jackpot game symbol.

Each primary game reel strip 702-710 and jackpot game reel strip 712 are therefore shown, at FIG. 9, in a stopped position. Windup image 802 may, as one or more reel strips 702-712 come to a halt, transform or change into a windup image 902. Windup image 902 may comprise any animated or still image that may be shown in association with selected jackpot game symbol 904, such as, for example, and in an illustrative embodiment, an animated image of a flame that engulfs or surrounds jackpot game reel strip 712 and/or jackpot symbol 904. In various embodiments, windup image 902 may include a more intense or larger flame than windup image 802.

In an exemplary embodiment, a jackpot award may include a progressive jackpot award. As used herein, a progressive jackpot award may include a shared jackpot award that is generated from a plurality of networked gaming machines, such as the networked gaming machines 202 described above. Further, in various embodiments, the gaming machines 202 contributing to a progressive jackpot award may include different primary and/or secondary games. For example, in an exemplary embodiment, a first networked gaming machine may enable a first primary and/or secondary game, while a second networked gaming machine may enable a second primary and/or secondary game.

Figure 10:
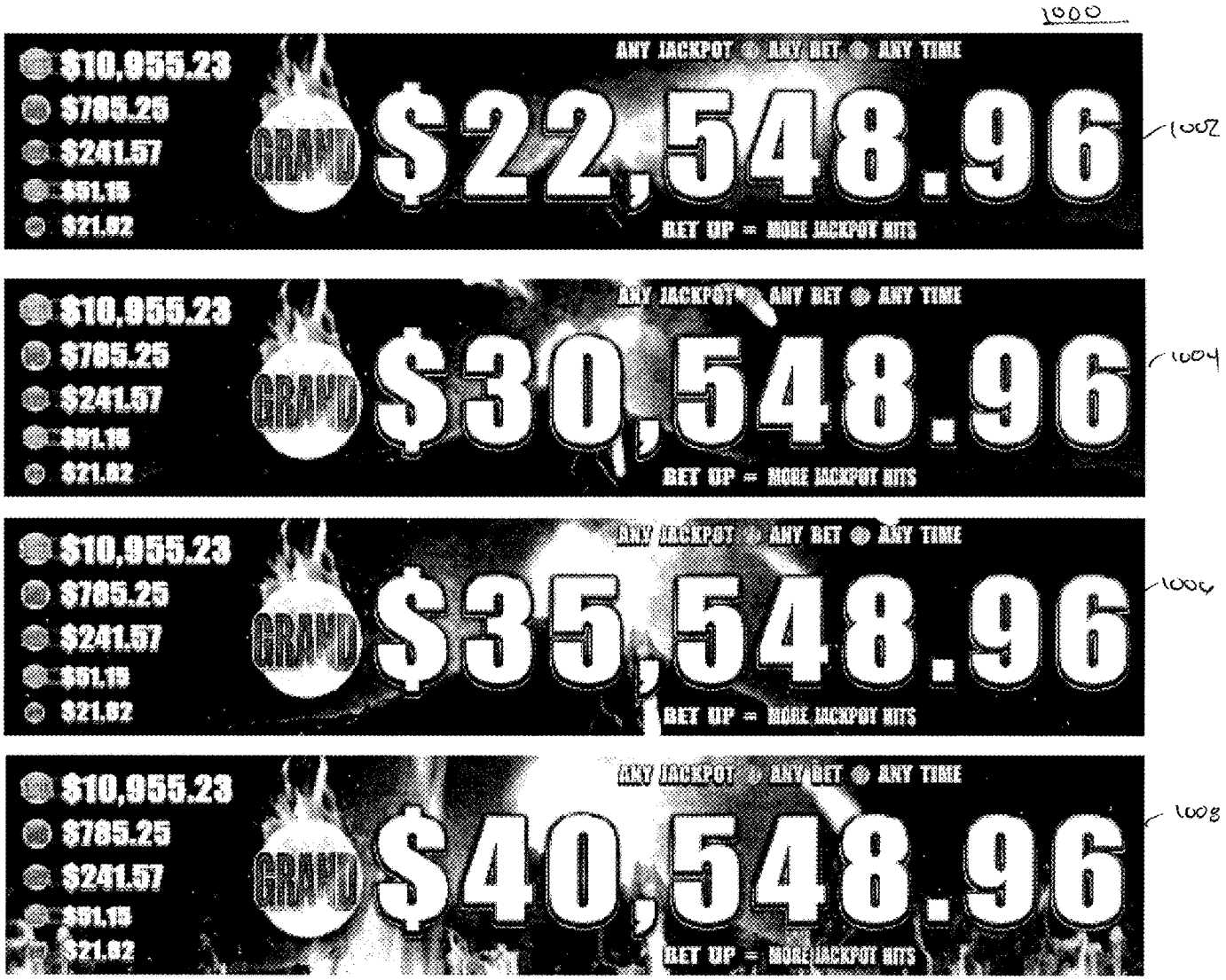
FIG. 10 is a screenshot of an exemplary overhead display.

With reference now to FIG. 10, screenshots of an exemplary embodiment of an overhead sign 1000 are shown. More particularly, exemplary sequences of images displayed by game controller 60 on an overhead sign of a gaming machine are shown. In an exemplary embodiment, overhead sign 1000 may display a first animation 1002 in association with a first jackpot award amount. First animation 1002 may, as shown, include a first lava flow or a first amount of lava.

As the jackpot award amount increases, overhead sign 1000 may display a second animation 1004 in association with a second jackpot award amount, which may signify an increase in the jackpot award amount. Second animation 1004 may, for example and as shown, include a second amount of lava that is greater than the first amount of lava. As the jackpot award amount continues to increase, overhead sign 1000 may display a third animation 1006 in association with a third jackpot award amount, which may signify an increase in the jackpot award amount. Third animation 1006 may, as shown, include a third amount of lava that is greater than the second amount of lava. Further still, as the jackpot award amount continues to increase, overhead sign 1000 may display a fourth animation 1008 in association with a fourth jackpot award amount, which may signify an increase in the jackpot award amount. Fourth animation 1008 may, as shown, include a fourth amount of lava that is greater than the third amount of lava.

Embodiments of the gaming machine describe above therefore facilitate a reel game that includes a concurrently played primary game and jackpot game. The outcome of the primary game may be based upon a combination of primary game symbols, while the outcome of the jackpot game may be based upon a single jackpot game symbol. Thus, a player may immediately understand what the jackpot award will be based solely upon the jackpot game symbol. A windup image may be introduced in association with a jackpot game reel strip to signal to the player that a jackpot award is going to land. Once a player is familiar with the windup image, the windup image may be selectively introduced to guide a player's attention between the jackpot reel strip and a plurality of primary game reel strips.

As indicated above, the method may be embodied in program code. The program code could be supplied in a number of ways, for example on a tangible computer readable storage medium, such as a disc or a memory device, e.g. an EEPROM, (for example, that could replace part of memory 103) or as a data signal (for example, by transmitting it from a server). Further different parts of the program code can be executed by different devices, for example in a client server relationship. Persons skilled in the art, will appreciate that program code provides a series of instructions executable by the processor.

It will be understood to persons skilled in the art that many modifications may be made without departing from the spirit and scope of the disclosure, in particular it will be apparent that certain features of embodiments of the disclosure can be employed to form further embodiments.

It is to be understood that, if any prior art is referred to herein, such reference does not constitute an admission that the prior art forms a part of the common general knowledge in the art in any country.

In the claims which follow and in the preceding description, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the disclosure.

What is claimed is:

1. An electronic method of gaming implemented using a gaming system, the gaming system including a main display configured to display a wagering game, a player input interface, a credit input mechanism including at least one of a card reader, a ticket reader, a bill acceptor, and a coin input mechanism, the credit input mechanism configured to establish a credit balance that is increasable and decreasable based on wagering activity, a tangible, non-transitory, computer-readable memory, and a game controller communicatively coupled to the memory, the method comprising:

controlling, by the game controller, the main display to display a plurality of primary game reel strips together on the main display with a single jackpot game reel strip, the plurality of primary game reel strips used for a primary game of the wagering game, the single jackpot game reel strip used for a jackpot game of the wagering game;

receiving, by the credit input mechanism, an initial wager;

selecting, by the game controller, a first portion of the initial wager to be applied to the primary game of the wagering game;

selecting, by the game controller, a second portion of the initial wager to be used in funding the jackpot game of the wagering game, wherein a value of the second portion is selected to cause a total jackpot of the jackpot game to increase at a rate that results in a jackpot award being provided from the total jackpot at a selected rate;

splitting, by the game controller, the initial wager into the first portion and the second portion;

funding, by the game controller, the total jackpot of the jackpot game using the second portion of the initial wager, wherein to fund the total jackpot using the second portion, the second portion is added to the total jackpot to cause the total jackpot to increase by the value of the second portion;

initiating, by the game controller, the primary game, wherein a wager amount for the primary game is the first portion of the initial wager;

selecting, by the game controller and in response to the initiating the primary game, a plurality of primary game symbols;

displaying, by the game controller, the plurality of primary game symbols in a plurality of symbol display positions associated with the plurality of primary game reel strips;

concurrently initiating, by the game controller, the jackpot game with the primary game, wherein a wager amount for the jackpot game is the second portion of the initial wager;

selecting, by the game controller and in response to the initiating the jackpot game, a jackpot game symbol from a plurality of jackpot game symbols;

displaying, by the game controller, the jackpot game symbol only in a symbol display position associated with the single jackpot game reel strip, wherein the jackpot game reel strip visually indicates that the jackpot game is ongoing and concurrent with the primary game;

determining, by the game controller, a primary game outcome based upon the plurality of primary game symbols and the first portion of the initial wager; and determining, by the game controller, a jackpot award from the total jackpot based only upon the jackpot game symbol, wherein the jackpot award is independent of the plurality of primary game symbols.

2. The method of claim 1 further comprising:

receiving, by the credit input mechanism, the initial wager in response to a single press of a play button by a player;

splitting, by the game controller, the initial wager into the first portion and the second portion in response to the single press of the play button by the player;

concurrently determining, by the game controller and in response to the single press of the play button by the player, the primary game outcome and the jackpot award;

simulating spinning and stopping, by the game controller and in response to the single press of the play button by the player, of the plurality of primary game reel strips to display the plurality of primary game symbols in the plurality of symbol display positions of the plurality of primary game reel strips; and concurrently simulating spinning and stopping, by the game controller and in response to the single press of the play button by the player, the single jackpot game reel strip to display the jackpot game symbol in the symbol display position associated with the single jackpot game reel strip.

3. The method of claim 1 further comprising:

initiating, by the game controller, a secondary game;

selecting, by the game controller and in response to the initiating the secondary game, a plurality of secondary game symbols;

displaying, by the game controller, the plurality of secondary game symbols in a plurality of symbol display positions associated with the plurality of primary game reel strips; and initiating, by the game controller and during the secondary game, the jackpot game.

4. The method of claim 1 further comprising displaying, by the game controller and in response to the selecting the jackpot game symbol, an animated image in relation to the jackpot game symbol.

5. The method of claim 4 further comprising displaying, by the game controller and in response to the selecting the jackpot game symbol, an animated image in relation to the single jackpot game reel strip.

6. An electronic gaming system comprising:

a primary display configured to display a plurality of primary game reel strips and a single jackpot game reel strip of a wagering game;

a player input interface configured to receive a player input;

a credit input mechanism including at least one of a card reader, a ticket reader, a bill acceptor, and a coin input mechanism, the credit input mechanism configured to receive an initial wager;

a game controller;

a tangible, non-transitory, computer-readable memory communicatively coupled to the game controller and having instructions stored thereon that, in response to execution by the game controller, cause the game controller to perform operations comprising:

controlling the primary display to display the plurality of primary game reel strips together on the primary display with the single jackpot game reel strip, the plurality of primary game reel strips used for a primary game of the wagering game, the single jackpot game reel strip used for a jackpot game of the wagering game;

selecting, by the game controller, a first portion of the initial wager to be applied to the primary game of the wagering game;

selecting, by the game controller, a second portion of the initial wager to be used in funding the jackpot game of the wagering game, wherein a value of the second portion is selected to cause a total jackpot of the jackpot game to increase at a rate that results in a jackpot award being provided from the total jackpot at a selected rate;

splitting, by the game controller, the initial wager into the first portion and the second portion;

funding, by the game controller, the total jackpot of the jackpot game using the second portion of the initial wager, wherein to fund the total jackpot using the second portion, the second portion is added to the total jackpot to cause the total jackpot to increase by the value of the second portion;

initiating, by the game controller the primary game, wherein a wager amount for the primary game is the first portion of the initial wager;

selecting, by the game controller and in response to the initiating the primary game, a plurality of primary game symbols;

displaying, by the game controller, the plurality of primary game symbols in a plurality of symbol display positions associated with the plurality of primary game reel strips;

concurrently initiating, by the game controller, the jackpot game with the primary game, wherein a wager amount for the jackpot game is the second portion of the initial wager;

selecting, by the game controller and in response to the initiating the jackpot game, a jackpot game symbol from a plurality of jackpot game symbols;

displaying, by the game controller, the jackpot game symbol only in a symbol display position associated with the single jackpot game reel strip, wherein the jackpot game reel strip visually indicates that the jackpot game is ongoing and concurrent with the primary game;

determining, by the game controller, a primary game outcome based upon the plurality of primary game symbols and the first portion of the initial wager; and determining, by the game controller, a jackpot award based only upon the jackpot game symbol, wherein the jackpot award is independent of the plurality of primary game symbols.

7. The system of claim 6 further comprising displaying, by the game controller, the plurality of primary game symbols concurrently with the jackpot game symbol.

8. The system of claim 6 further comprising:

initiating, by the game controller, a secondary game;

selecting, by the game controller and in response to the initiating the secondary game, a plurality of secondary game symbols;

displaying, by the game controller, the plurality of secondary game symbols in a plurality of symbol display positions associated with the plurality of primary game reel strips; and initiating, by the game controller and during the secondary game, the jackpot game.

9. The system of claim 6 further comprising displaying, by the game controller and in response to the selecting the jackpot game symbol, an animated image in relation to the jackpot game symbol.

10. The system of claim 9 further comprising displaying, by the game controller and in response to the selecting the jackpot game symbol, an animated image in relation to the single jackpot game reel strip.

11. An article of manufacture including a non-transitory, tangible, computer readable storage medium having instructions stored thereon that, in response to execution by a game controller configured for electronic gaming, cause the game controller to perform operations comprising:

controlling one display to display a plurality of primary game reel strips together on the one display with the single jackpot game reel strip, the plurality of primary game reel strips used for a primary game of the wagering game, the single jackpot game reel strip used for a jackpot game of the wagering game selecting, by the game controller, a first portion of an initial wager to be applied to the primary game of a wagering game;

selecting, by the game controller, a second portion of the initial wager to be used in funding the jackpot game of the wagering game, wherein a value of the second portion is selected to cause a total jackpot of the jackpot game to increase at a rate that results in a jackpot award being provided from the total jackpot at a selected rate;

splitting, by the game controller, the initial wager into the first portion and the second portion;

funding, by the game controller, the total jackpot of the jackpot game using the second portion of the initial wager, wherein to fund the total jackpot using the second portion, the second portion is added to the total jackpot to cause the total jackpot to increase by the value of the second portion;

initiating, by the game controller, the primary game, wherein a wager amount for the primary game is the first portion of the initial wager;

selecting, by the game controller and in response to the initiating the primary game, a plurality of primary game symbols;

displaying, by the game controller, the plurality of primary game symbols in a plurality of symbol display positions associated with the plurality of primary game reel strips;

concurrently initiating, by the game controller, the jackpot game with the primary game, wherein a wager amount for the jackpot game is the second portion of the initial wager;

selecting, by the game controller and in response to the initiating the jackpot game, a jackpot game symbol from a plurality of jackpot game symbols;

displaying, by the game controller, the jackpot game symbol in a symbol display position associated with the single jackpot game reel strip, wherein the jackpot game reel strip visually indicates that the jackpot game is ongoing and concurrent with the primary game;

determining, by the game controller, a primary game outcome based upon the plurality of primary game symbols and the first portion of the initial wager; and determining, by the game controller, a jackpot award based only upon the jackpot game symbol, wherein the jackpot award is independent of the plurality of primary game symbols.

12. The article of claim 11 further comprising displaying, by the game controller, the plurality of primary game symbols concurrently with the jackpot game symbol.

13. The article of claim 11 further comprising:

initiating, by the game controller, a secondary game;

selecting, by the game controller and in response to the initiating the secondary game, a plurality of secondary game symbols;

displaying, by the game controller, the plurality of secondary game symbols in a plurality of symbol display positions associated with the plurality of primary game reel strips; and initiating, by the game controller and during the secondary game, the jackpot game.

14. The article of claim 11 further comprising displaying, by the game controller and in response to the selecting the jackpot game symbol, an animated image in relation to at least one of the jackpot game symbol or the single reel strip.

15. The method of claim 1, wherein the selected rate is one in one-hundred-and-twenty-five, whereby at least one jackpot is provided from the total jackpot at least every one in one-hundred-and-twenty-five spins of the jackpot game reel strip.

* * * * *